United States Patent [19]

Liska

[11] 4,080,895

[45] Mar. 28, 1978

[54] DEVICE FOR THE TRIPPING OF PRINTING CYLINDER INTO PRESSURE CONTACT

[75] Inventor: Zbynek Liska, Adamov, Czechoslovakia

[73] Assignee: Adamovske strojirny, narodni podnik, Adamov, Czechoslovakia

[21] Appl. No.: 796,678

[22] Filed: May 13, 1977

Related U.S. Application Data

[63] Continuation-in-part of Ser. No. 707,522, Jul. 22, 1976, abandoned.

[30] Foreign Application Priority Data

Aug. 5, 1975 Czechoslovakia ..... 5443/75

[51] Int. Cl.[2] ..... B41F 13/24

[52] U.S. Cl. ..... 101/218; 101/144

[58] Field of Search ..... 101/217, 218, 247, 137, 101/139, 140, 143, 144, 145, 184, 185

[56] References Cited

U.S. PATENT DOCUMENTS

| | | | |
|---|---|---|---|
| 2,845,860 | 8/1958 | Mestre | 101/218 X |
| 3,584,578 | 6/1971 | Jurny | 101/218 |
| 3,618,516 | 11/1971 | Jurny | 101/218 |

*Primary Examiner*—J. Reed Fisher

*Attorney, Agent, or Firm*—Burgess, Ryan and Wayne

[57] ABSTRACT

An apparatus for tripping into pressure contact and release an offset cylinder utilizing a worm-shaped body firmly mounted on the cylinder shaft and provided with a worm in engagement with a worm wheel rotatably mounted on the shaft and provided with an integrally formed lever connected by a carrier pivot with a pull rod for tripping the pressure cylinder. The worm-shaped body is divided by an adjustable clamping recess, while the carrier pivot is shiftably arranged on one end of a pull spring, the other end being attached to a wall of the printing machine.

4 Claims, 4 Drawing Figures

図-1

DEVICE FOR THE TRIPPING OF PRINTING CYLINDER INTO PRESSURE CONTACT

CROSS REFERENCE TO RELATED APPLICATIONS

This application is a continuation-in-part of co-pending application Ser. No. 707,522, filed July 22, 1976, now abandoned.

This invention relates to a device for tripping of a printing cylinder selectively into pressure contact and release on printing machines according to thickness and quality of paper sheets to be printed.

Different devices are in use for the tripping of cylinders into pressure contact on printing machines, with the aim that the printing pressure will remain constant when the thickness or the quality of the paper sheets is changed.

Generally, in these devices, the distance between the impression cylinder and the offset cylinder is regulated.

With hitherto known devices the shaft of the offset cylinder is adjustable and the distance between impression cylinder and offset cylinder is changed by adjusting the setting.

One of the known devices of this kind has the offset cylinder mounted on an eccentric shaft. By turning the eccentric shaft by means of a ratchet wheel and by a securing link, the eccentric shaft is rotated to trip the printing cylinders into pressure contact and release. The setting of the distance between the impression and the offset cylinder is carried out in such a manner that by turning of an eccentric pivot the distance between the offset cylinder and the impression cylinder is changed.

A disadvantage of the device described above is that after setting the distance of the printing cylinder according to the thickness of the paper sheets to be printed, the set position of the mechanism is not secured, because the mechanism is held by the securing link only on one side.

Another known device for the tripping of the cylinders of a printing machine into pressure contact works on the same basis as described above, but the setting and regulation of the distance of the offset cylinder from the impression cylinder is carried out by means of a worm wheel and other worms, which are arranged on both sides of the printing machine, whereby the named elements function independently of each other.

A disadvantage of such device is that the setting of the mechanism thereof must be carried out for each change of paper sheet thickness or quality accurately and individually on both sides of the printing machine, which is very difficult for the operator.

A further known device is arranged in such a way that on the shaft of the offset cylinder are mounted shaped discs, which are arranged in rotatable rings. By the turning of the shaft of the offset cylinder, the change of the printing pressure between the impression cylinder and the offset cylinder is achieved by means of two levers, one of which is rotatably mounted on the shaft of the offset cylinder and the other of which is firmly mounted on the shaft. The proper regulation is carried out by a regulating screw, by which said levers are moved toward or away from each other, thereby changing the distance of the offset cylinder from the impression cylinder. Such a device is exemplified by U.S. Pat. No. 3,618,516.

A disadvantage of the above device is that it is necessary to carry out the setting of the distance of the offset cylinder from the impression cylinder on both sides of the offset cylinder, whereby the securing of the position thereof by means of a pull spring does not provide the necessary stability.

Also of interest is U.S. Pat. No. 2,845,860, which is directed to the regulation of the printing pressure between the printing cylinders of a printing machine. In the device disclosed in this patent, a toothed segment 111 is turned by means of a screw 113, and the segment 111 is rigidly connected by a screw 110 to a shaft 33. Thus, simultaneously with the turning of the toothed segment 111, the shaft 33 also turns. On the shaft are fixed two eccentric discs 32 and 34, which control the tripping of the printing cylinders into and out of pressure contact. The disc 34 controls the tripping of the cylinders into the off or non-printing position. Thus, this reference operates in a completely different manner than applicant's device, as hereafter described.

The above named disadvantages are avoided by a device according to the present invention, wherein on a shaft of an offset cylinder, there is firmly mounted a worm-shaped body, in which is arranged a worm, which is in engagement with a worm wheel, which is rotatably mounted on the shaft of the offset cylinder and is provided with a carrier lever integrally formed therewith, the carrier lever being connected by a carrier pivot with a pull rod for the tripping of the printing cylinder and the worm-shaped body being divided in the bottom part thereof by a clamping recess, formed along the cavity, in which is arranged a securing screw. The carrier pivot is engaged by a hinging eye which is formed on one end of a pull-spring, the other end being hinged on a pivot fixed in a side wall of the printing machine. On the worm-shaped body, there is formed a projection, in which is attached a stop screw which bears on the carrier lever.

The advantage of the above device according to the invention is that after the tripping of the offset cylinder according to the thickness of the paper sheets to be printed, the mechanism is secured by means of the securing screw, the worm-shaped body and the carrier lever being together firmly connected, so that the whole mechanism is rigid on both sides.

A further advantage of the above device is in that after tripping the printing cylinders into printing pressure contact, the clearance of the pivots and pull rods of the mechanism is taken up by the pull rod, so that an undesired vibration of the shaft of the offset cylinder by the influence of the rotation offset cylinder is made impossible. When the printing pressure is tripped off, the mechanism is free, as no pressure from the spring is applied to it.

A further advantage of the device according to the invention is in the easy manipulation of tripping the printing cylinders into printing pressure contact and release. Furthermore, the central arrangement of the control mechanism secures the mechanism with the stop screw against improper operation by the operating personnel.

An embodiment of the present invention will now be described by way of example with reference to the accompanying drawing, in which FIG. 1 shows a front view of the device with a partial section in a position, when the printing machine is tripped into printing pressure;

Figure 1:
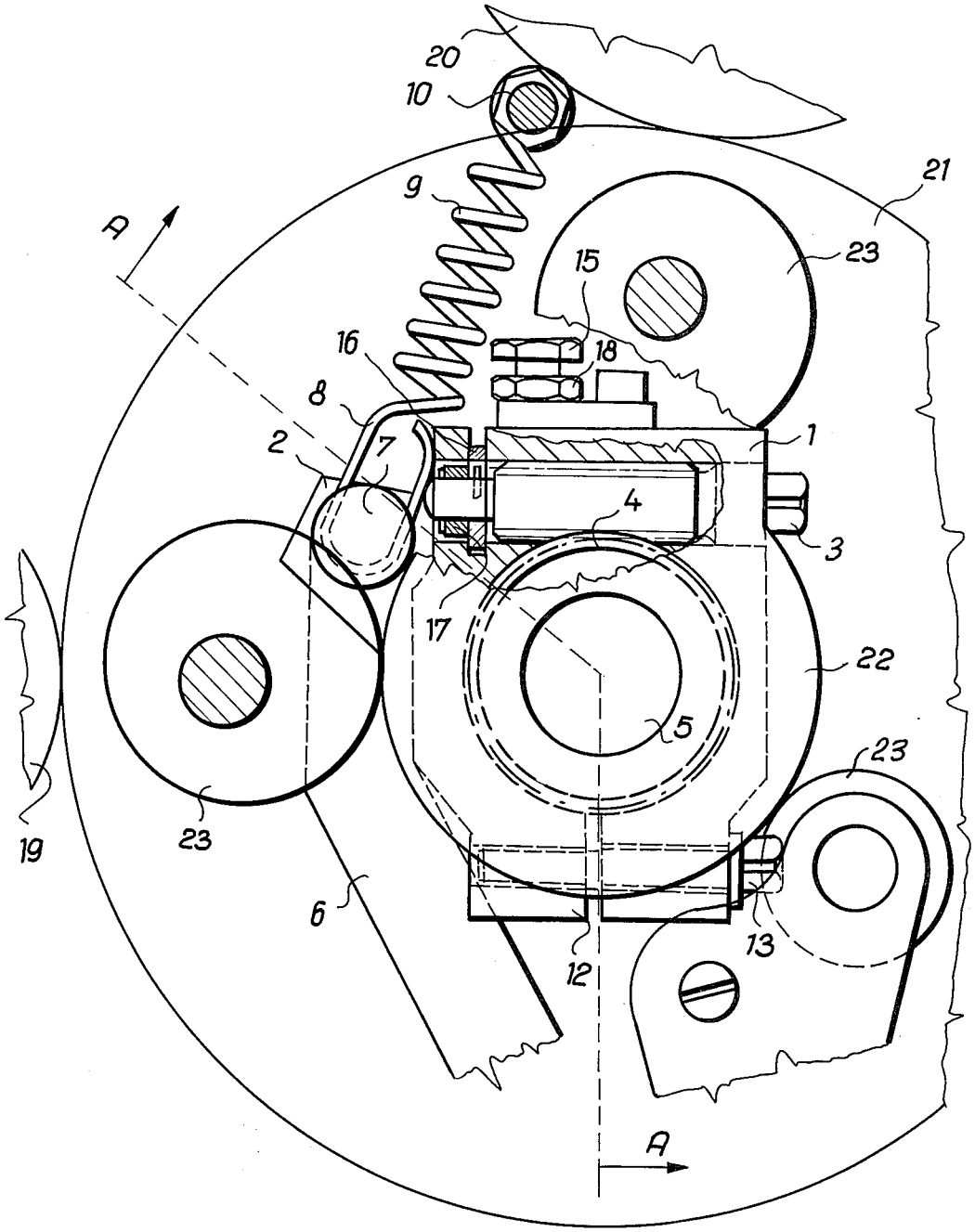

A portion of a printing machine embodying the present invention is shown in FIGS. 1 to 4, in which an offset cylinder 21 is rotatably mounted on a stationary shaft 5, and peripherally engaged by a rotatable impression cylinder 19 and a rotatable form cylinder 20. The pressure of engagement between the cylinders 19 and 20 and the offset cylinder 21 is controlled by a pull-rod 6 which is connected to a conventional mechanism (not illustrated) for tripping the cylinders into printing pressure contact.

Although the drawings show a tripping device according to the invention on one end of the shaft 5, it should be understood that two such tripping devices are employed, one mounted on each end of said shaft. Either tripping device may be adjusted in the manner hereafter described, and after the initial adjustment both tripping devices are locked in position. Therefore the following description should be taken as referring to a pair of the devices described, rather than a single device.

Figure 4:
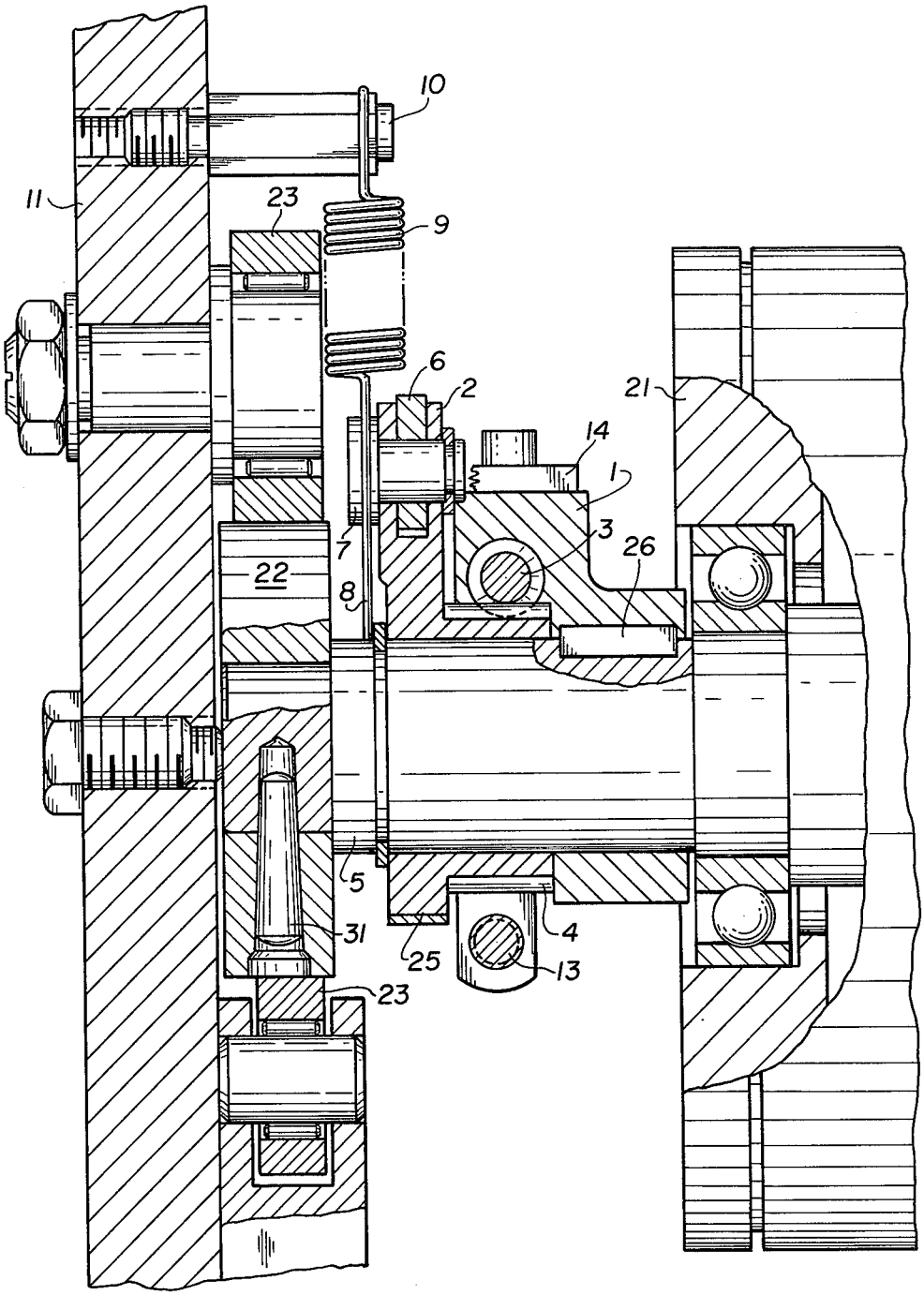
FIG. 4 shows a partial section along the plane A—A of FIG. 1.

As most clearly shown in FIG. 4, a worm-shaped body 1 is secured to the shaft 5 for rotation therewith by means of a key 26. A screw wheel 4 is rotatably mounted on the shaft 5 adjacent the worm-shaped body 1, in such a manner that a shoulder region of the worm-shaped body 1 overlies a portion of the screw wheel 4. The worm-shaped body 1 has a hole therein in which is situated a worm screw 3 which is secured against axial sliding movement by means of a washer 16 and nut 17. The screw 3 engages axially oriented threads of the screw wheel 4, so that turning of the screw wheel 3 results in corresponding rotational movement of the screw wheel 4 about the shaft 5. The bottom part of the worm-shaped body 1 is split to form a clamping recess 12, the portions of the body 1 adjacent the clamping recess 12 being drawn toward each other by means of a securing screw 13 to lock the screw wheel 4 against the shaft 5 by the frictional force therebetween.

Thus, the rotational position of the screw wheel 4 with respect to the shaft 5 may be adjusted by loosening the clamping screw 13, turning the worm screw 3 to rotate the screw wheel 4 to a desired position, and then re-tightening the clamping screw 3.

A carrier lever 2 is formed as an integral part of the screw wheel 4 and extends outwardly therefrom in the form of a tab or projection. The carrier lever 2 has a pivot pin 7 secured thereto, one end of the pull rod 6 having an aperture through which the carrier pivot pin 7 extends, to pivotally secure the pull-rod 6 to the carrier lever 2. As previously mentioned, the other end of the pull-rod 6 is connected to a mechanism for the tripping of the cylinders 19 and 20 into printing pressure contact with the cylinder 21. The pivot pin 7 also engages an elongated eye 8 of a pull-spring 9, the other end of said pull-spring being secured to a pivot pin 10 affixed to a side wall 11 of the printing machine.

The worm-shaped body 1 is also provided with a projection 14 (see FIG. 3) having a threaded hole for receiving a stop screw 15 which is provided with a securing or locking nut 18. The screw wheel 4 has a hub portion 25 on which index marks are scribed adjacent a reference mark 24 on the worm body 1. The hub portion 25 of the screw wheel 4 also has a shoulder or step 30 to provide a reference stop, and relative motion between the screw wheel 4 and worm body 1 beyond the stop 30 is prevented by engagement of the end of the stop screw 15 with the vertical or step portion of the stop 30.

As previously mentioned, the position of the screw wheel 4, carrier lever 2 and pivot pin 7 affects the printing pressure, due to the movement of the end of the pull rod 6 therewith.

A cam disc 22 is permanently secured to the end of the shaft 5 by means of a securing screw or pin 31. The periphery of the disc 22 has three detents or recesses which are engageable with the three rollers 23 when the disc 22 is in a predetermined reference rotational position. The rollers 23 are each rotatably mounted on pivots which are fixed in the side walls 11 of the printing machine.

In initially assembling the device, the "stationary" (i.e., stationary during the printing operation) offset cylinder 21 is turned until the rollers 23 engage the detents or recesses in the surface of the cam disc 22 affixed to said shaft. Then the clamping screw 13 is loosened, and the worm screw 3 is turned until the stop screw 15 bears against the shoulder 30 on the hub of the carrier lever 2. In this position, the scale 25 is attached to the hub of the carrier lever 2 so that the zero value of the scale appears opposite the index mark 24 on the worm-shaped body 1. Then the clamping screw 13 is turned to clamp the worm-shaped body 1 against the screw wheel 4 to secure the same against the shaft 5 for rotation therewith.

To adjust the device for printing paper sheets of various thicknesses, the securing screw 13 is loosened, and the worm screw 3 is turned to set the scale 25 at a predetermined value with respect to the index mark 24. This is done while the printing cylinders are tripped off, i.e., while the cylinders 19 and 20 are not in engagement with the cylinder 21. Thereafter, the clamping screw 13 is again tightened to secure the screw wheel 4 for rotation with the shaft 5.

Figure 2:
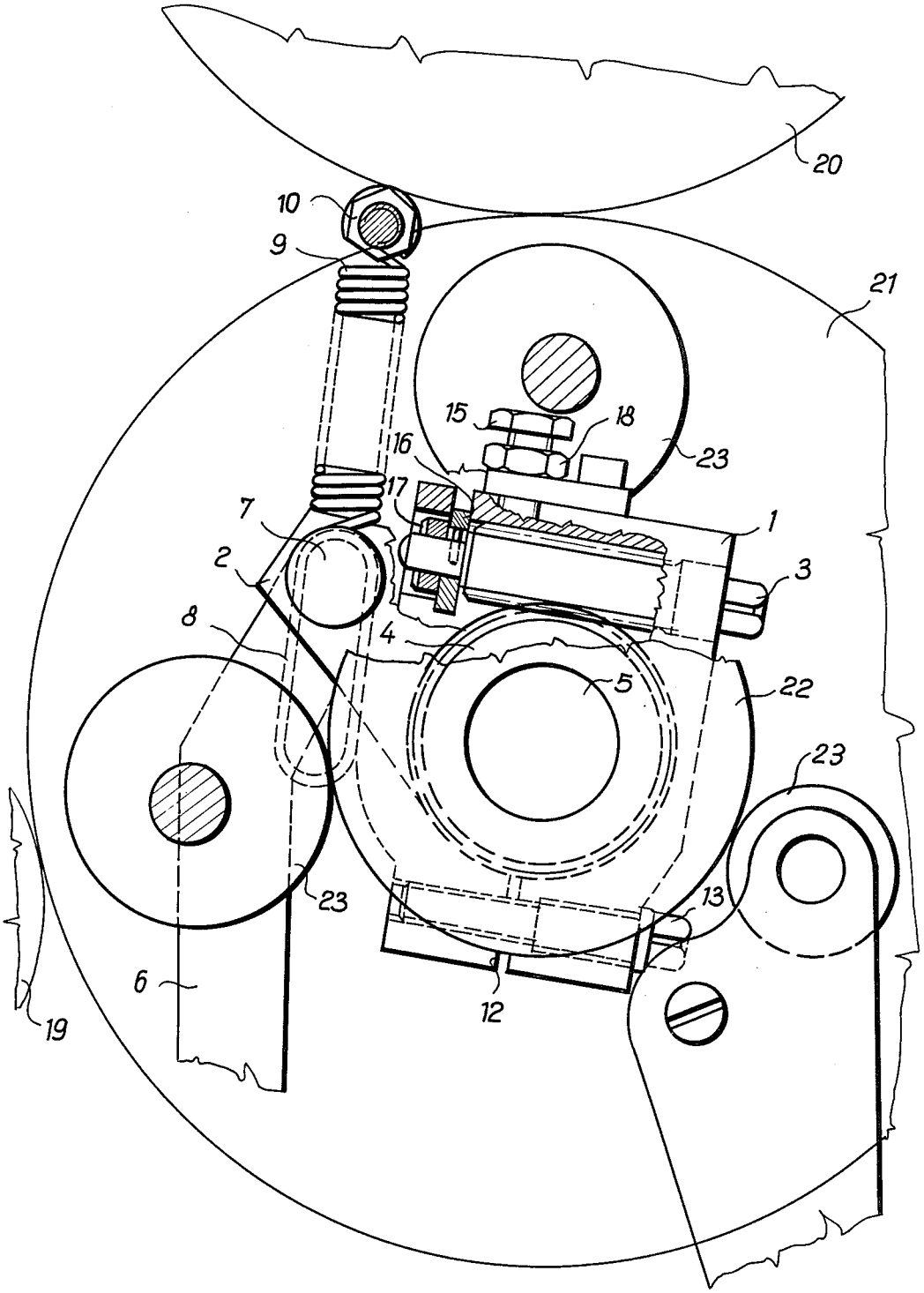
FIG. 2 is a front view of the device in partial section, when the printing machine is tripped off printing pressure.
Figure 3:
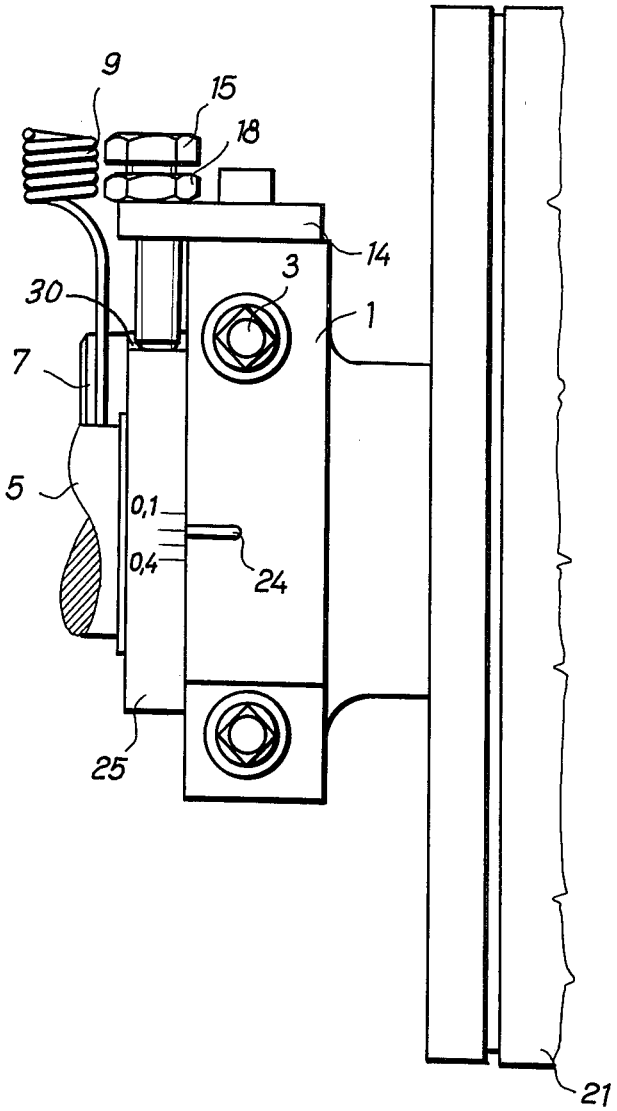
FIG. 3 illustrates a partial side view of FIG. 1.

As shown most clearly in FIG. 2, in the preset initial position of the carrier lever 2 and pivot pin 7, the pull spring 9 is not in tension, so that the "stationary" shaft 5 is able to turn through an angle (determined by the length of the elongated eye 8) without said turning being impeded by the spring 9.

As soon as the printing cylinders are tripped by means of a pull-rod 6, the pull-rod 6 moves downward and exerts a pulling force on the pivot pin 7, carrier lever 2, screw wheel 4 and shaft 5 to rotate these elements until the pivot pin 7 engages the end of the eye 8 of the pull spring 9, whereupon the pull spring 9 begins to stretch and to resist further rotational movement of the shaft 5. Thus, the pull spring 9 serves to eliminate undesired vibration of the printing mechanism and to effectively eliminate undesirable effects due to all the clearances of the pivots and pull-rods of the entire device.

While the aforementioned description has related only to the device situated at one end of the shaft 5, it should be understood that after a desired setting is made on the device at one end, it is merely necessary to follow the same procedure to set the device at the other end of the same shaft at the same reading of the scale 25 as that to which the prior device was set.

What is claimed is:

1. A device for tripping printing cylinders into printing pressure, particularly on offset printing machines, where the regulation of the printing pressure is carried out by tripping an offset cylinder in accordance with the thickness or quality of paper to be printed, comprising a shaft, an offset cylinder rotatably mounted on said shaft, a worm-shaped body rigidly mounted on said shaft, a worm in said worm-shaped body, a worm wheel rotatably mounted on said shaft and threadably engaged with said worm, a carrier lever integrally formed with said worm wheel, a pull rod for tripping the printing cylinders, a carrier pivot connecting the pull rod to the carrier lever for tripping the printing cylinders into printing pressure contact and release, said worm-shaped body being provided with a clamping groove dividing said worm-shaped body, and a securing screw passing through said clamping groove for selectively clamping a portion of said worm-shaped body against a portion of said worm wheel and said shaft to secure said wheel for rotation with said shaft.

2. A device according to claim 1, further comprising a pull spring pivotally connected to a side wall of said printing machine, said pull spring being provided on one end with an elongated eye, pivotally engaging said carrier pivot.

3. A device according to claim 1, wherein said worm-shaped body is provided with a projection, and further comprising a stop screw passing through said projection and seating on said carrier lever.

4. A device according to claim 3, further comprising a stop shoulder on a hub portion of said worm wheel for engaging said stop screw.

* * * * *